US011707101B2

(12) United States Patent
Fringero

(10) Patent No.: US 11,707,101 B2
(45) Date of Patent: Jul. 25, 2023

(54) ADVERTIZING APPARATUS

(71) Applicant: Boaz Fringero, Herzliya (IL)

(72) Inventor: Boaz Fringero, Herzliya (IL)

( * ) Notice: Subject to any disclaimer, the term of this patent is extended or adjusted under 35 U.S.C. 154(b) by 461 days.

(21) Appl. No.: 16/893,064

(22) Filed: Jun. 4, 2020

(65) Prior Publication Data

US 2020/0297055 A1 Sep. 24, 2020

Related U.S. Application Data

(63) Continuation-in-part of application No. 15/575,366, filed as application No. PCT/IB2016/052932 on May 19, 2016, now Pat. No. 10,745,918.

(60) Provisional application No. 62/857,275, filed on Jun. 4, 2019, provisional application No. 62/163,465, filed on May 19, 2015.

(51) Int. Cl.

| | |
|---|---|
| ***G09F 17/00*** | (2006.01) |
| ***A42B 1/004*** | (2021.01) |
| ***G09F 19/00*** | (2006.01) |

(52) U.S. Cl.

CPC ..... *A42B 1/004* (2013.01); *G09F 17/00* (2013.01); *G09F 19/00* (2013.01)

(58) Field of Classification Search

CPC .. G09F 17/00; G09F 19/00; G09F 2017/0033; G09F 19/12; G09F 13/08

See application file for complete search history.

(56) References Cited

U.S. PATENT DOCUMENTS

| | | | | | |
|---|---|---|---|---|---|
| 218,750 | A ‡ | 8/1879 | Jory | G09F 13/06 | 40/580 |
| 276,152 | A ‡ | 4/1883 | Barricklo | A47L 23/26 | 428/54 |
| 320,245 | A ‡ | 6/1885 | Hamm | E06B 9/40 | 160/238 |
| 928,774 | A ‡ | 7/1909 | Livergood | A45B 25/18 | 135/33.71 |
| 1,879,695 | A ‡ | 9/1932 | Leissner | A47H 23/02 | 112/405 |
| 2,152,845 | A ‡ | 4/1939 | Hays | G09F 13/26 | 40/577 |
| 2,336,265 | A ‡ | 12/1943 | Lester | D06M 15/07 | 106/169.37 |
| 2,554,204 | A ‡ | 5/1951 | Mueller | A45B 11/00 | 135/19.5 |

(Continued)

FOREIGN PATENT DOCUMENTS

| | | | | |
|---|---|---|---|---|
| DE | 102014220818 A1 ‡ | 4/2016 | ..... | E06B 9/24 |
| DE | 102016013695 A1 ‡ | 5/2018 | ..... | F21V 3/00 |

(Continued)

*Primary Examiner* — Gary C Hoge

(74) *Attorney, Agent, or Firm* — Jose Cherson Weissbrot

(57) ABSTRACT

A head cover includes a brim formed from a plastic sheet. The plastic sheet includes a first area with a material having a first degree of transparency to light and a second area at least partially surrounded by the first area, the second area including a material having a second degree of transparency to light different from the first area. The second area further includes a shape of a logo. At least one of the first area and the second area project an image of the logo onto a surface or object distantly located from the brim when a light impinges on the brim. The head cover is a cap, a visor, or a hat.

16 Claims, 7 Drawing Sheets

(56) References Cited

U.S. PATENT DOCUMENTS 2,563,353 A ‡ 8/1951 Mueller ..... A45B 11/00 135/19.5
2,823,477 A ‡ 2/1958 Willard ..... F21V 1/00 40/554
D195,252 S ‡ 5/1963 Nikolich ..... D25/149
3,308,872 A ‡ 3/1967 Smith ..... A47H 23/04 160/120
3,456,106 A ‡ 7/1969 Gluschkin ..... F21V 1/00 362/97.1
4,263,737 A ‡ 4/1981 Simon ..... G09F 13/08 283/56
4,316,337 A ‡ 2/1982 Da Costa ..... G09F 13/08 40/564
4,817,315 A ‡ 4/1989 Kammerer ..... G09F 13/08 40/441
5,128,850 A ‡ 7/1992 Juodvalkis ..... F21V 3/00 362/224
D339,910 S ‡ 10/1993 Flanagan ..... D11/55
5,682,939 A ‡ 11/1997 Vargo ..... A47H 23/04 160/121.1
5,823,212 A ‡ 10/1998 Allen ..... A45B 25/00 135/16
D415,644 S ‡ 10/1999 Goodwin ..... D6/575
6,223,758 B1 ‡ 5/2001 Feldman ..... A45B 25/02 135/15.1
6,558,022 B2 ‡ 5/2003 Kawahara ..... F21S 10/007 362/257
6,651,720 B1 ‡ 11/2003 DiSilvestro ..... E06B 9/40 160/121.1
6,672,748 B2 ‡ 1/2004 Baldwin ..... G09F 13/00 362/222
6,698,122 B1 * 3/2004 Merenlender ..... G09F 17/00 40/606.18
7,171,772 B1 ‡ 2/2007 Male ..... G09F 13/04 40/541
9,169,690 B2 ‡ 10/2015 Blair ..... E06B 9/24
9,175,509 B2 ‡ 11/2015 Clarren ..... E06B 9/24
9,744,803 B2 ‡ 8/2017 Walant ..... B44C 1/005
2004/0213007 A1 ‡ 10/2004 Portillo ..... G09F 19/18 362/487
2005/0285415 A1 ‡ 12/2005 Metts, IV ..... B60J 7/102 293/10
2007/0085050 A1 ‡ 4/2007 Scheidler ..... D06M 13/35 252/8.61
2007/0281158 A1 ‡ 12/2007 Glew ..... D02G 3/443 428/375
2008/0223423 A1 ‡ 9/2008 Kupferman ..... A45B 25/18 135/33.7
2009/0158631 A1 * 6/2009 Christiansen ..... G06Q 30/0256 40/607.04
2012/0211038 A1 ‡ 8/2012 Pirshafiey ..... A47C 21/003 135/96
2013/0258678 A1 ‡ 10/2013 Nichols ..... F21V 11/16 362/351
2013/0306247 A1 ‡ 11/2013 Spurgers ..... E06B 9/24 160/12
2014/0113153 A1 ‡ 4/2014 Afonso ..... B32B 27/08 428/518
2014/0022635 A1 ‡ 8/2014 Hernandez ..... B60J 7/0007 362/50
2014/0226351 A1 ‡ 8/2014 Hernandez ..... B60J 1/2041 362/509
2014/0305477 A1 ‡ 10/2014 Zemach ..... A45B 3/04 135/33.2
2014/0347724 A1 ‡ 11/2014 Schultz ..... G03B 21/62 359/450
2014/0352747 A1 ‡ 12/2014 Aycan ..... A45B 23/00 135/121
2015/0337593 A1 ‡ 11/2015 Pricone ..... E06B 9/40 160/238
2016/0123034 A1 ‡ 5/2016 Leathers ..... E04H 15/02 135/161
2017/0367448 A1 ‡ 12/2017 Solotoff ..... A45B 25/30
2018/0155953 A1 * 6/2018 Fringero ..... E06B 9/24
2019/0151733 A1 * 5/2019 Peterson ..... A63B 71/0605

FOREIGN PATENT DOCUMENTS

FR 2660783 A1 10/1991
JP 2007108387 A 2/2007
JP 2007047263 A 4/2007
WO WO-9415508 A1 ‡ 7/1994 ..... A47H 23/06
WO WO-02072972 A1 ‡ 9/2002 ..... A01G 9/222

* cited by examiner
‡ imported from a related application

ADVERTIZING APPARATUS

CROSS REFERENCE TO RELATED APPLICATIONS

This application is a continuation-in-part of U.S. patent application Ser. No. 15/575,366 filed on 19 Nov. 2017 as a 35 U.S.C. 371 national stage application of international application number PCT/IB2016/052932 with international filing date 19 May 2016; and additionally claims the benefit of priority from U.S. Provisional Patent Application No. 62/857,275 filed on 4 Jun. 2019, U.S. Provisional Patent Application No. 62/163,465 filed on 19 May 2015, and Australian Divisional Application No. 2021203372 filed on 25 May 2021.

The contents of all the above applications are incorporated by reference as if fully set forth herein.

FIELD OF THE INVENTION

The present invention, in some embodiments thereof, relates to advertising apparatus for promotional purposes and, more particularly, but not exclusively, to a projecting advertising apparatus for promotional purposes.

BACKGROUND OF THE INVENTION

Head covers may include hats, caps, and visors which serve to protect a user's head and/or face from exposure to the sun. These head covers generally include a brim which may serve to protect the wearer's face from the sun, and optionally other upper body sections such as the shoulders and the upper back. Emblems, symbols, figures, writing, numbers, and other design patterns, hereinafter referred to as "logo", may sometimes be attached to the brim, generally for promotion or advertising purposes, among other possible uses. These may be woven onto the brim, especially when the brim includes a fabric, or may be adhered usually in the form of a sticker, as is frequently the case when the brim is plastic.

SUMMARY OF THE INVENTION

There is provided, in accordance with an embodiment of the present invention, a head cover including a brim formed from a plastic sheet suitable to project an image of a logo on the brim onto a distant surface. The plastic sheet may include a first area having a material with a first degree of transparency to light, and a second area at least partially surrounded by the first area and having a material with a second degree of transparency to light different from the first area, and further including a shape of the logo. At least one of the first area and the second area may project an image of the logo onto the distant surface when a light impinges on the brim. The head cover may be a cap, a visor, or a hat.

There is additionally provided, in accordance with an embodiment of the present invention, an advertising apparatus for promotional purposes including a flag or a banner (hereinafter referred to as "flag" for convenience), the apparatus including a flexible plastic sheet supported by a structure, a first area on the plastic sheet including a printed shape of the logo, the first area including a material substantially transparent to impinging light and suitable to project an image of the logo onto a surface or object distantly located from the plastic sheet, the first area surrounded by a second area including a material having a lower transparency to the light relative to the first area.

There is additionally provided, in accordance with an embodiment of the present invention, a method of projecting an image of a logo on an advertising apparatus for promotional purposes including a sail flag, the method including, on a flexible plastic sheet supported by a structure, illuminating a first area on the plastic sheet including a printed shape of the logo, the first area including a material substantially transparent to impinging light and suitable to project an image of the logo onto a surface or object distantly located from the plastic sheet, the first area surrounded by a second area including a material having a lower transparency to the light relative to the first area.

In some embodiments, the advertising apparatus includes a support structure to position the flexible plastic sheet in a vertical position, a horizontal position, and/or at an angle.

In some embodiments, the advertising apparatus includes a boat sail.

In some embodiments, the material in the second area may include a higher transparency to light relative to the first area. Alternatively, the material in the first area may include a higher transparency to light relative to the second area. The light may be solar light or electrical light. Optionally, the first area and the second area may be on an underside of the plastic sheet.

In some embodiments, the plastic sheet may include UV filtering in a range between 80%-99%.

In some embodiments, the first area may be opaque. Alternatively, the second area may be opaque.

In some embodiments, the logo shape may include a digitally printed shape, a flexographic printed shape, or a silk screen printed shape.

In some embodiments, the projected image of the logo on the distant surface may be an illuminated image. Alternatively, the projected image may be a shadow of the logo.

In some embodiments, the material on the first area may include an ink color different from that on the material on the second area. Optionally, the material on the first area includes a different thickness compared to the material on the second area.

In some embodiments, the second area may include a removable logo.

BRIEF DESCRIPTION OF THE DRAWINGS

Some embodiments of the invention are herein described, by way of example only, with reference to the accompanying drawings. Details shown are for exemplary purposes and serve to provide a discussion of embodiments of the invention. The description and the drawings may be apparent to those skilled in the art how embodiments of the invention may be practiced.

DETAILED DESCRIPTION OF THE INVENTION

Figure 1A:
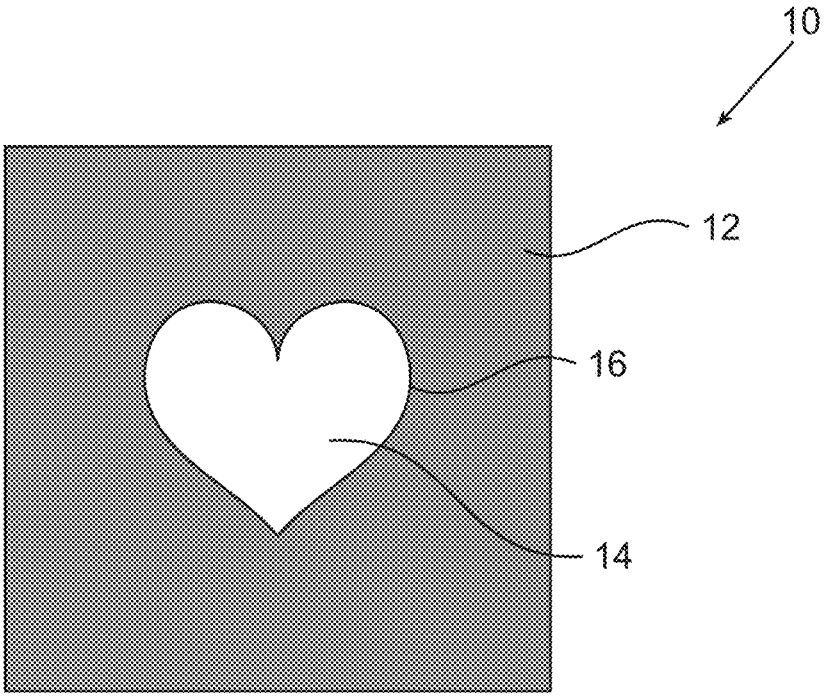
FIG. 1A schematically illustrates a first method of generating a projected image of a logo from a brim section of a head cover such as hat, a cap, or a visor, according to an embodiment of the present invention.

Before explaining at least one embodiment of the invention in detail, it is to be understood that the invention is not necessarily limited in its application to the details of construction and the arrangement of the components and/or methods set forth in the following description and/or illustrated in the drawings. The invention is capable of other embodiments or of being practiced or carried out in various ways.

Applicant has realized that the teachings described in the now allowed parent application, U.S. patent application Ser. No. 15/575,366, and in U.S. Provisional Patent Application No. 62/163,465 from which the parent application claimed the benefit of priority and which is also incorporated herein by reference in its entirety, may be equally applied to numerous types of projecting advertising apparatus for promotional purposes, ranging from the projector sunshade described in the parent application which may include flags or banners on support structures, or boat sails, to wearable items such as head covers, for example, to hats, visors and caps. By using the printing methods described therein, Applicant, in addition to the projector sunshade including flags (or banners) is also able to provide a head cover which provides a wearer with the required protection from the sunshine while allowing use of sunlight, optionally light from other light sources, to project an image of a logo on the head cover onto a distant surface. Accordingly, a first embodiment of the present invention relates to a head cover including a logo on the brim which may be projected onto a remote surface when light impinges on the brim. The remote surface may include a body section of a wearer of the head cover, a garment section worn by the wearer, a body section or a garment section of a non-wearer (i.e. proximal to the user), an object, among other remote surfaces. A second embodiment of the present invention relates to a flag which includes the canopy supported vertically or alternatively sloping on a supporting structure described in the parent application. The flag or banner may include, but not be limited to, sail flags, sail banners, garden flags, wind banners, and feather banners.

In some embodiments, the brim may be divided into a background area and one or more logo areas (each logo area may include a logo). The background area may be partially transparent or translucent, or alternatively opaque, with the one or more logo areas being substantially transparent to allow sunlight to pass through to cast the projected image of the logo as an illuminated image. Alternatively, the one or more logo areas may be partially transparent or translucent, or alternatively opaque, with the background area being substantially transparent to allow casting of the projected image of the logo as a shadow image. Optionally, the background area and/or the one or more logo areas may be colored to allow casting of colored projected images.

In some embodiments, the brim of the head cover may be formed from a plastic material which may include any suitable flexible, semi-flexible, or rigid plastic which may be printed on such as, for example, PVC, Polyethylene, and Polypropylene. Optionally, only sections of the brim may be formed from plastic, for example, the background area or alternatively the one or more logo areas, in order to allow these areas to cast the projected logo image while the other areas may be formed from other materials, for example, cardboard, fabric, and paper, among other materials.

In an embodiment of the present invention, the printing method may include digital printing to print onto a transparent plastic sheet which may be used to form the brim of the head cover. The size of the ink drops may range from 0-60 Pico liters or greater, for example 30 Pico liters. Ink coverage may range from 10-100%, depending on the degree of shading required surrounding the projected image or images, for example, 75%. A preferable thickness of the ink coat layer may range from 10-50 microns, although other thicknesses may be possible.

In some embodiments of the present invention, the printing method may include using flexographic printing. The flexographic printing may apply one or more coating of ink depending on the degree of shading and the color of the shading required for the brim and optionally for the projected image when the logo is formed using a negative print technique, for example, 3 coatings. Other printing methods may include silk screen printing.

In some embodiments, the logo may include letters, number, figures, symbols, colors, patterns, or any combination thereof. The printing may be applied to a side of the transparent plastic which will not be directly exposed to the UV radiation from the sun when used as the sunshade cover, for example, to the underside of the transparent plastic. Optionally, the plastic sheet may be UV-treated. UV filtering may range from 0%-99%, although preferably around 90%, for example, 80%, 82%, 86%, 89%, 90%, 92%, 94%, 95%.

Reference is now made to FIG. 1A which schematically illustrates a first method of generating a projected image of a logo 16 from a brim section 10 of a head cover such as a hat, cap, or visor, according to an embodiment of the present invention. Brim section 10 may include a background area 12 and a logo area 14.

Background area 12 and logo area 14 may be formed from a plastic sheet, optionally UV-treated, which may be a same sheet or sections from different sheets which may be attached together. Background area 12 may be printed with an amount of ink to achieve a degree of transparency different from that of logo area 14. Optionally, background area 12 may be translucent. Ink printing may include use of digital printing techniques, flexographic printing techniques, or silk screen printing techniques.

In some embodiments, logo area 14 may include an amount of ink, or optionally none at all, so that the area is substantially transparent to allow the light to pass through and project an image of logo 16 onto a remote surface. In some embodiments, logo area 14 may be formed with ink of a different color than that used for background area 12 to allow the projected image to have a different color from that which may be projected by the background area. In some embodiments, background area 12 may be opaque. In some embodiments, background area may include a fabric or other non-plastic material, and logo 16 may be formed by cutting the logo area 14 onto the fabric or other non-plastic material and covering the logo area with the plastic.

In some embodiments, background area 12 may include an amount of ink, or optionally none at all, so that the area is substantially transparent to allow the light to pass through. Logo area 14 may be printed with an amount of ink to have a lower transparency compared to background area 12, and may be optionally opaque, to prevent light from passing through. Alternatively, logo area may not include printing and may be, for example, a sticker including a logo which may be adhered to the brim and may substantially prevent light from passing through. The effect of having the background area with a higher degree of transparency relative to the logo area may cast an image of the logo as a shadow.

Figure 1B:
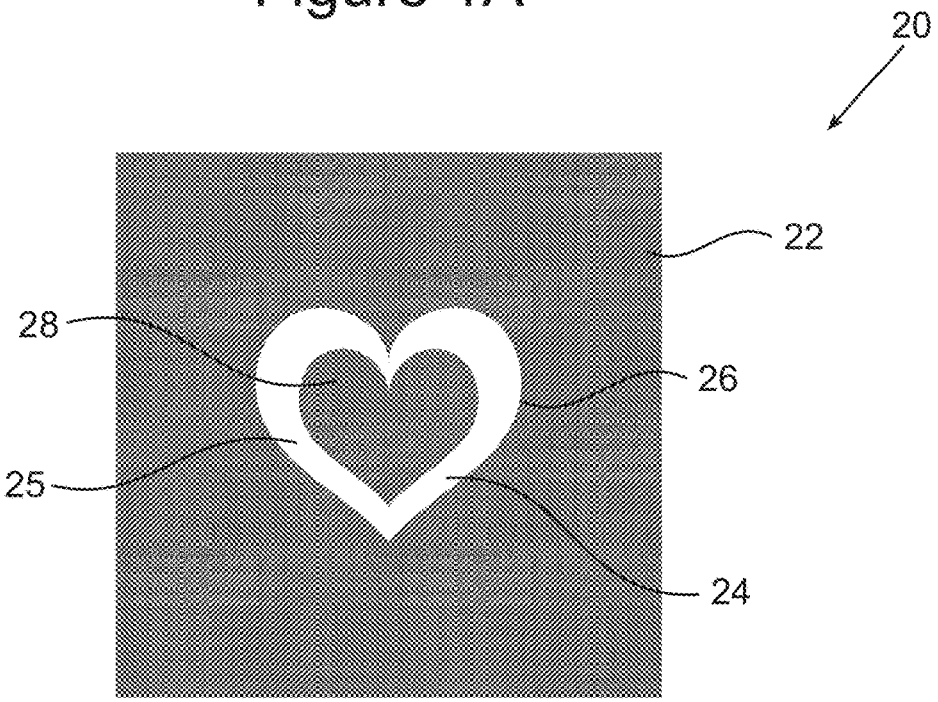
FIG. 1B schematically illustrates a second method of generating a projected image of a logo from a brim section of a head cover such as hat, a cap, or a visor, and which includes us of a negative printing technique, according to an embodiment of the present invention.

Reference is now made to FIG. 1B which schematically illustrates a second method of generating a projected image of a logo 26 from a brim section 20 of a head cover such as a hat, cap, or visor and which includes use of a negative printing technique, according to an embodiment of the present invention. Brim section 20 may include a background area 22 and a logo area 24.

Background area 22 and logo area 24 may be substantially similar to background area 12 and logo area 14 shown in FIG. 1A, with the exception that logo area includes an inner area 28 which may be formed with an amount of ink which may be similar to that of the background area, and may optionally be translucent. Alternatively, the amount and/or color of inner area 28 may be different than that of background area 22.

In some embodiments, the inclusion of inner area 28 may allow the sun to pass through a frame 25 formed between background area 22 and the inner area. In this case, inner area 28 may cast a shadow and the projected image of logo 26 may include the shadow. The projected image of logo 26 may be in contrast with the method of FIG. 1A where the projected image of logo 16 is substantially allowing all of the light to pass through logo area 14.

Figure 2:
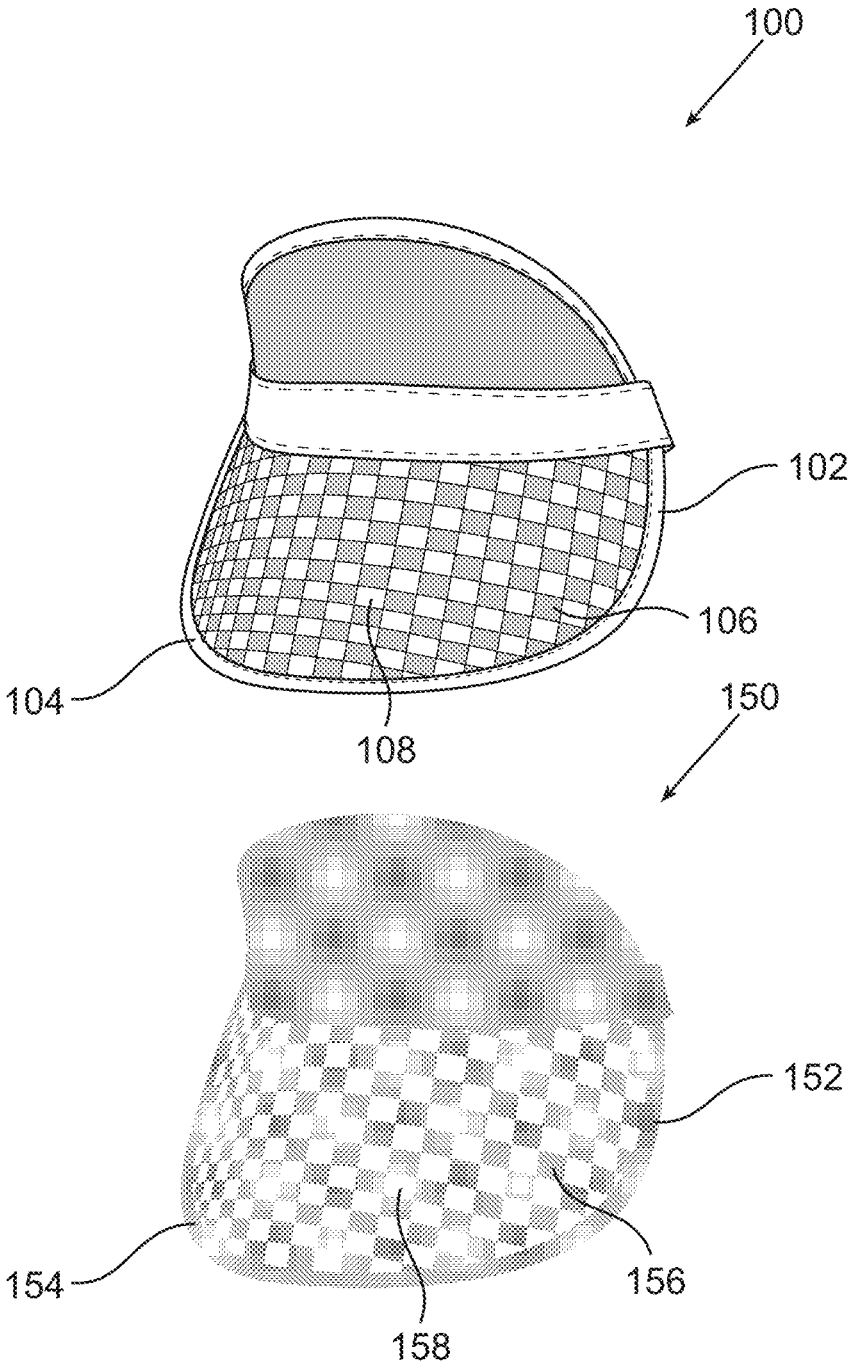
FIG. 2 schematically illustrates an exemplary visor which may be worn to protect the face of a wearer from exposure to sunrays and suitable to project an image of a logo onto a remote surface, according to an embodiment of the present invention.

Reference is now made to FIG. 2 which schematically illustrates an exemplary visor 100 which may be worn to protect the face of a wearer from exposure to sunrays and suitable to project an image of a logo onto a remote surface, according to an embodiment of the present invention. Visor 100 may include a brim 102 with an edge 104, a background area 106, and a plurality of logo areas 108. The arrangement of background area 106 and logo areas 108 shown in the figure is for exemplary purposes, and the skilled person may readily appreciate that the background area and the logo area may be implemented with any type of background and logo arrangement, as previously described with reference to FIGS. 1A and 1B.

As may be appreciated from the figure, logo areas 108 may include square shapes and may be distributed throughout the background area 106 in a checkerboard arrangement. Logo areas 108 may allow the sun rays to substantially pass through while background area 106 may partially or wholly prevent the sunrays from passing through, allowing visor 100 to cast a shadow which may include a projection of an image of the visor including the logo areas onto a remote surface, as may be seen by visor shadow 150.

As may be further appreciated from the figure, visor shadow 150 may include a brim shadow 152 having an edge shadow 154 and a background shadow 156 due to the partial or whole blocking of light impinging on brim edge 104 and background 106. Light passing through logo areas 108 may project logo images 158 on the remote surface, so that the combination of the background shadow 156 with the logo images 158 may generate a projected image of the checkerboard arrangement on brim 102.

Any one of the methods described in FIGS. 1A and 1B may be used to generate logo images 158 and to project an image of visor 100, that is, visor shadow 150, on the remote surface. Furthermore, it may be appreciated that edge shadow 154 and/or background shadow 156 may not necessarily be shadows rather may also be contrasting images relative to logo images 158 (e.g. different color).

Figure 3:
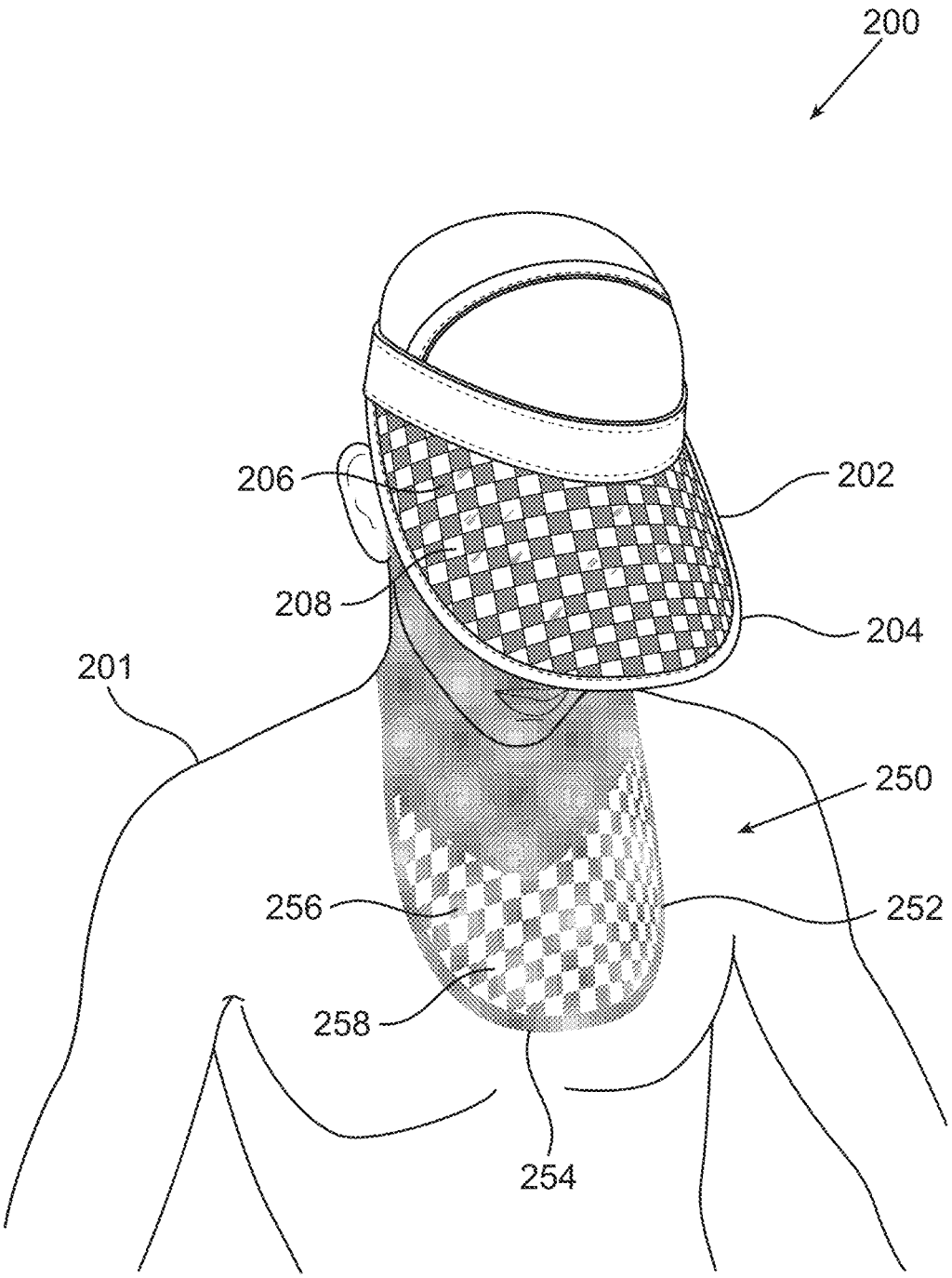
FIG. 3 schematically illustrates an exemplary cap with a brim suitable to project an image of a logo onto a remote surface, for example a wearer's chest, according to an embodiment of the present invention.

Reference is now made to FIG. 3 which schematically illustrates an exemplary cap 200 with a brim 202 suitable to project an image of a logo onto a remote surface, according to an embodiment of the present invention. Cap 200 may include a brim 202 with an edge 204, a background area 206, and a plurality of logo areas 208.

As may be appreciated from the figure, logo areas 208 may include square shapes and may be distributed throughout the background area 206 in a checkerboard arrangement. Logo areas 208 may allow the sun rays to substantially pass through while background area 206 may partially or wholly prevent the sunrays from passing through, allowing cap 200 to cast a shadow which may include a projection of an image of the visor including the logo areas onto a remote surface, for example, on the chest of a wearer 201, as may be seen by cap shadow 250.

As may be further appreciated from the figure, cap shadow image 250 may include a brim shadow 252 having a shadow edge 254 and a background shadow 256. Light passing through logo areas 208 may project logo images 258 on the remote surface, so that the combination of background shadow 256 with logo images 258 may generate a projected image of the checkerboard arrangement on brim 202 onto the chest of wearer 201.

As previously described in relation to FIG. 2, any of the methods described in FIGS. 1A and 1B may be used to generate logo images 258 and to project an image of cap 200, that is, cap shadow 250, on the remote surface. Furthermore, it may be appreciated that edge shadow 254 and/or background shadow 256 may not necessarily be shadows rather may also be contrasting images relative to logo images 258 (e.g. different color). Additionally, the arrangement of background area 206 and logo areas 208 shown in the figure is for exemplary purposes, and the skilled person may readily appreciate that the background area and the logo area may be implemented with any type of background and logo arrangement.

Figure 4:
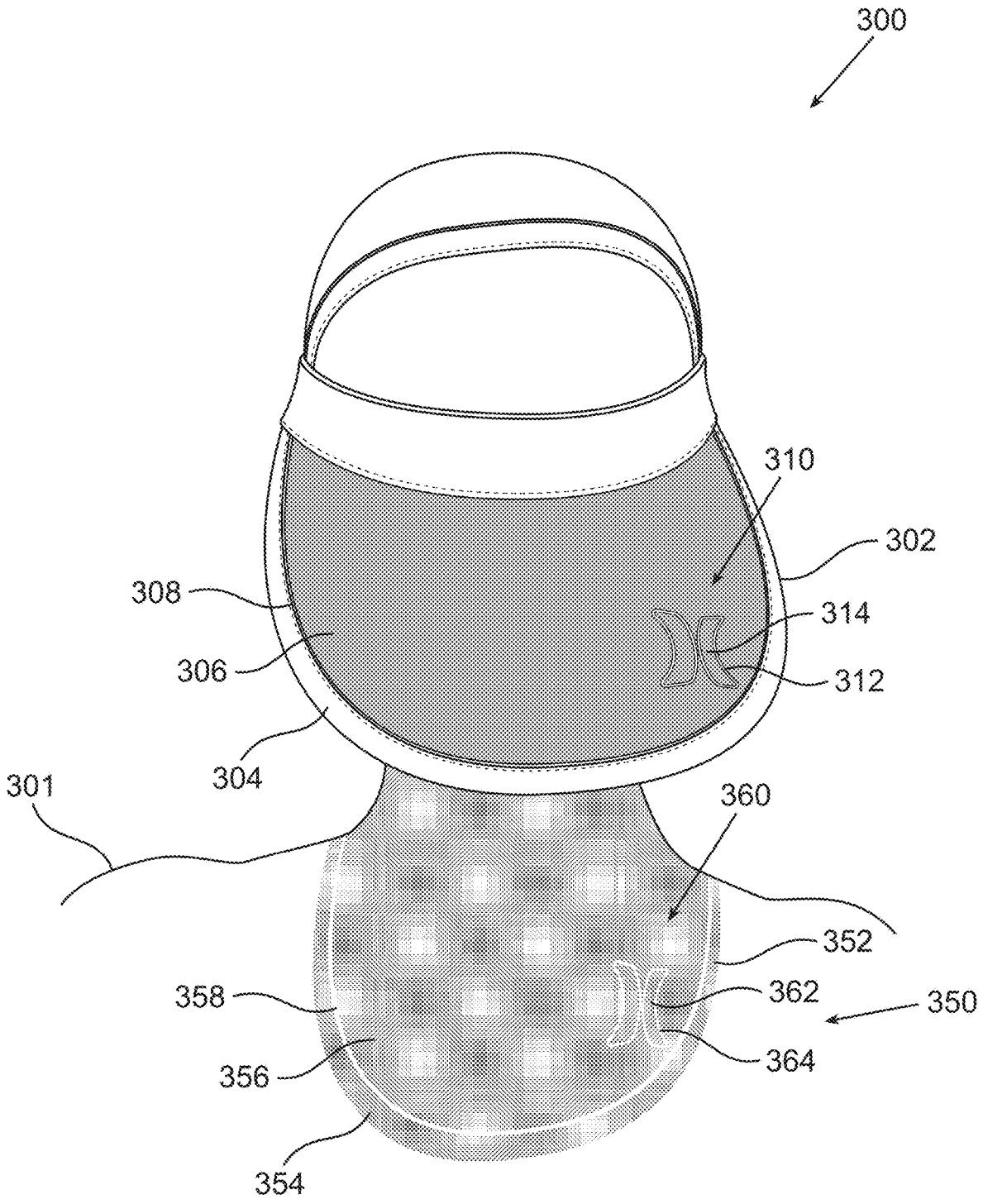
FIG. 4 schematically illustrates an exemplary cap with a brim suitable to project an image of a logo onto a remote surface, for example a wearer's upper back, according to an embodiment of the present invention.

Reference is now made to FIG. 4 which schematically illustrates an exemplary cap 300 with a brim 302 suitable to project an image of a logo onto a remote surface, according to an embodiment of the present invention. Cap 300 may include a brim 302 with an edge 304 and a background area 306 separated by a first logo area 308 which may form a first frame. Brim 302 may additionally include a second logo area 310 which may be formed by a second frame 312 separating between background area 306 and an inner area 314, similar to that described in FIG. 1B. First frame 308 and second frame 312 may allow the sun rays to substantially pass through while edge 304 and background area 306 may partially or wholly prevent the sunrays from passing through, allowing cap 300 to cast a shadow which may include a projection of an image of the visor including the logo areas onto a remote surface, for example, on the back of a wearer 301, as may be seen by cap shadow 350.

As may be further appreciated from the figure, cap shadow 350 may include a brim shadow 352 having an edge shadow 354 and a background shadow 356. Light passing through first frame 308 may project a first logo image 358. Light passing through second frame 312 may project a second logo image 360 which may include a frame image 362 surrounding an inner area shadow 364 on the remote surface. Consequently, an image of brim 302 including the first logo area 308 and the second logo area 310 is projected onto the remote surface (i.e. the back of wearer 301).

Any of the methods described with reference to FIGS. 1A and 1B may be used to generate first logo image 308 and second logo image 310, and to project an image of cap 300, that is, cap shadow 350, on the remote surface. Furthermore, it may be appreciated that edge shadow 354 and/or background shadow 356 and inner area shadow 364 may not necessarily be shadows rather may also be contrasting images relative to the logo images (e.g. different color). Additionally, as previously mentioned with regards to FIG. 2, the arrangement of background area 306 and first logo area 308 and second logo area 310 shown in the figure is for exemplary purposes, and the skilled person may readily appreciate that the background area and the logo areas may be implemented with any type of background and logo arrangement.

Figure 5:
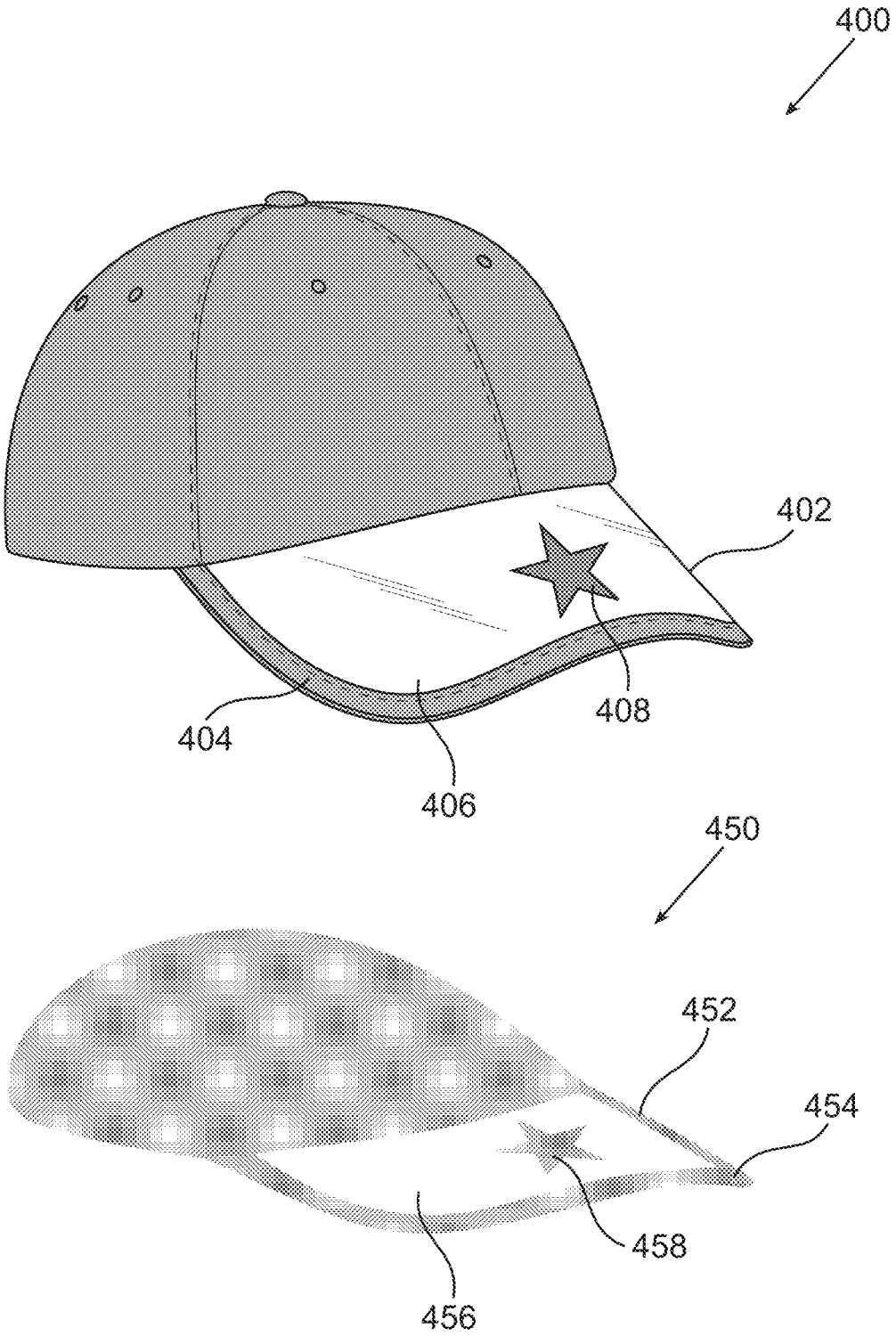
FIG. 5 schematically illustrates an exemplary cap with a brim suitable to project an image of a logo onto a remote surface and having a background area which is substantially transparent compared to the logo area, or of a different degree of transparency and/or color compared to the logo area, according to an embodiment of the present invention.
Figure 6:
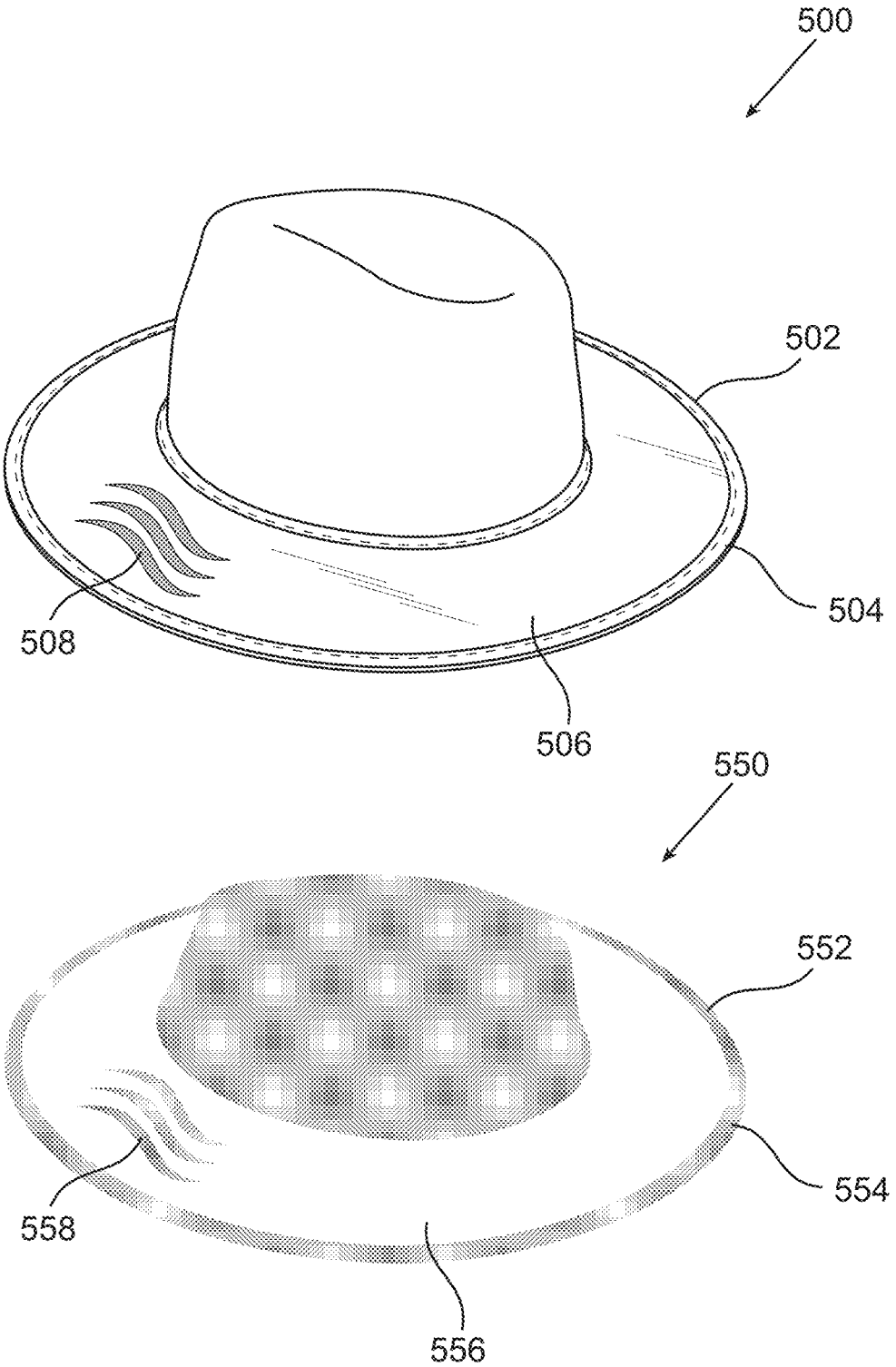
FIG. 6 schematically illustrates an exemplary hat with a brim suitable to project an image of a logo onto a remote surface and having a background area which is substantially transparent compared to the logo area, or of a different degree of transparency and/or color compared to the logo area, according to an embodiment of the present invention.

Reference is now made to FIG. 5 and to FIG. 6 which schematically illustrate other exemplary implementations of the teachings of the present invention. In these exemplary implementations, as shown by the embodiments of FIGS. 5 and 6, the background area may be substantially transparent to allow the impinging light to pass through, and the logo area may be substantially opaque to cast a shadow, or of a different degree of transparency and/or color to project a contrasting image.

In FIG. 5 may be seen a cap 400 including a brim 402 with a brim edge 404, a substantially transparent background area 406, and an opaque logo area 408. As may be appreciated from the figure, impinging light on cap 400 projects a cap shadow 450 including a brim shadow 452 having an edge shadow 454, a background image 456, and a logo shadow 458.

In FIG. 6 may be seen a hat 500 including a brim 502 with a brim edge 504, a substantially transparent background area 506, and an opaque logo area 508. As may be appreciated from the figure, impinging light on hat 500 projects a hat shadow 550 including a brim shadow 552 having an edge shadow 554, a background image 556, and a logo shadow 558.

Figure 7:
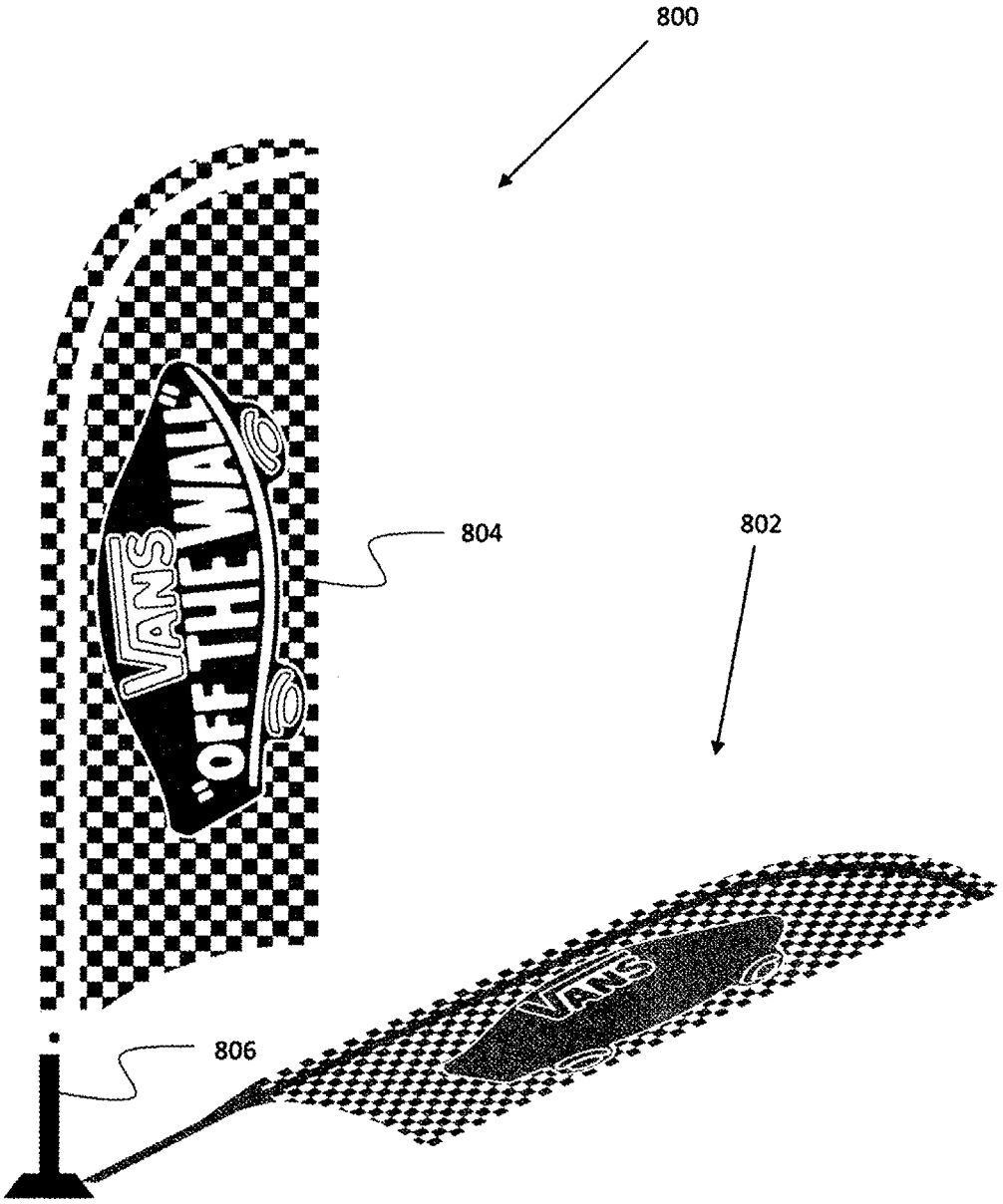
FIG. 7 schematically illustrates an exemplary sail flag or sail banner, according to an embodiment of the present invention.

Reference is now made to FIG. 7 which schematically illustrates an exemplary sail flag 800, according to an embodiment of the present invention. Sail flag 800, which may also be a sail banner, may include a flexible plastic projector sheet 804 configured to project an image of a logo onto a remote surface, and a supporting structure 806 to support the projector sheet. Projector sheet 804 may allow the sun rays and other types of illumination to pass through and to project an image of the logo on the ground, as shown in shadow 802. Any of the methods described with reference to FIGS. 1A and 1B may be used on projector sheet 804 to generate the image of the logo on the ground.

Sail flag 800 is shown in the figure with projector sheet 804 in a vertical configuration. Nevertheless, it may be appreciated that sail flag 800 may be implemented in other configurations so that projector sheet 804 may be oriented horizontally or at an angle (sloping). It may be further appreciated that sail flag 800 may include flexible projection section 804 having different shapes, for example, as a drop flag, a feather flag, a quadrilateral flag, a winder flag, a garden flag, a wind banner, among other shapes, and may include more than one projector section, for example, two or three projector sections.

The foregoing description and illustrations of the embodiments of the invention has been presented for the purposes of illustration. It is not intended to be exhaustive or to limit the invention to the above description in any form.

Any term that has been defined above and used in the claims, should to be interpreted according to this definition.

What is claimed is:

1. An advertising apparatus for promotional purposes including a flag or banner and comprising:

a flexible plastic sheet;

a first area on said plastic sheet comprising a printed shape of a logo, said first area comprising a material transparent to impinging light and suitable to project an image of said logo onto a surface or object distantly located from said plastic sheet;

a second area on said plastic sheet surrounding said first area and comprising a material having a lower transparency to said light relative to said first area; and a support structure to position said flexible plastic sheet in a vertical position, a horizontal position, and/or at an angle.

2. The advertising apparatus according to claim 1 wherein said first area and said second area are on a same side of said plastic sheet.

3. The advertising apparatus according to claim 1 where said second area is translucent.

4. The advertising apparatus according to claim 1 wherein said second area is opaque.

5. The advertising apparatus according to claim 1 wherein said printed shape comprises a digitally printed shape, a flexographic printed shape, or a silk screen printed shape.

6. A method of forming an advertising apparatus for promotional purposes including a banner or flag, the method comprising:

on a flexible plastic sheet, creating a first area comprising a shape of a logo, said first area comprising a material transparent to impinging light and suitable to project an image of said logo onto a surface or object distantly located from said plastic sheet;

on said plastic sheet, surrounding said first area with a second area comprising a material having a lower transparency to said light relative to said first area; and securing said flexible plastic sheet to a support structure.

7. The method according to claim 6 wherein said support structure is configured to position said flexible plastic sheet in a vertical position, a horizontal position, and/or at an angle.

8. The method according to claim 6 wherein said first area and said second area are on a same side of said plastic sheet.

9. The method according to claim 6 where said second area is translucent.

10. The method according to claim 6 wherein said second area is opaque.

11. The method according to claim 6 wherein said printed shape comprises a digitally printed shape, a flexographic printed shape, or a silk screen printed shape.

12. A method of projecting an image of a logo on an advertising apparatus for promotional purposes including a sail banner or sail flag, the method comprising:

on a flexible plastic sheet supported by a structure, illuminating a first area on said plastic sheet comprising a printed shape of the logo, said first area comprising a material substantially transparent to impinging light and suitable to project an image of the logo onto a surface or object distantly located from said plastic sheet, said first area surrounded by a second area comprising a material having a lower transparency to said light relative to said first area.

13. The method according to claim 12 wherein said support structure is configured to position said flexible plastic sheet in a vertical position, a horizontal position, and/or at an angle.

14. The method according to claim 12 wherein said first area and said second area are on an underside of the plastic sheet.

15. The method according to claim 12 where said second area is translucent.

16. The method according to claim 12 wherein said second area is opaque.

* * * * *